US011804655B2

(12) United States Patent
Wu et al.

(10) Patent No.: US 11,804,655 B2
(45) Date of Patent: Oct. 31, 2023

(54) WI-FI ANTENNA DEVICE AND WIRELESS COMMUNICATION DEVICE HAVING THE SAME

(71) Applicant: LANNER ELECTRONICS INC., New Taipei (TW)

(72) Inventors: Jung-Tai Wu, New Taipei (TW); Yun-Hung Chen, New Taipei (TW)

(73) Assignee: LANNER ELECTRONICS INC., New Taipei (TW)

( * ) Notice: Subject to any disclaimer, the term of this patent is extended or adjusted under 35 U.S.C. 154(b) by 66 days.

(21) Appl. No.: 17/730,525

(22) Filed: Apr. 27, 2022

(65) Prior Publication Data

US 2023/0042885 A1 Feb. 9, 2023

(30) Foreign Application Priority Data

Aug. 4, 2021 (TW) ..... 110128769

(51) Int. Cl.
*H01Q 21/20* (2006.01)
*H01Q 9/04* (2006.01)
*H01Q 9/30* (2006.01)

(52) U.S. Cl.
CPC ..... *H01Q 9/0414* (2013.01); *H01Q 9/30* (2013.01); *H01Q 21/20* (2013.01)

(58) Field of Classification Search
CPC ..... H01Q 9/0414; H01Q 9/30; H01Q 21/20; H01Q 1/02; H01Q 1/42; H01Q 3/08; H01Q 5/42; H01Q 9/0421; H01Q 21/205; H01Q 1/2291
See application file for complete search history.

(56) References Cited

U.S. PATENT DOCUMENTS

2014/0139393 A1* 5/2014 Yoon ..... H01Q 9/42 343/845
2017/0264016 A1* 9/2017 Huang ..... H01Q 7/00
2018/0342807 A1* 11/2018 Watson ..... H01Q 9/0421
2019/0372203 A1* 12/2019 Su ..... H01Q 1/246
2020/0303807 A1* 9/2020 Caratelli ..... H01Q 1/2291
2021/0226650 A1* 7/2021 Zhao ..... H01Q 5/40
2022/0344836 A1* 10/2022 Caratelli ..... H01Q 1/2291

* cited by examiner

*Primary Examiner* — Hai V Tran
*Assistant Examiner* — Michael M Bouizza

(57) ABSTRACT

A Wi-Fi antenna device is disclosed. The Wi-Fi antenna device comprises a ground plane, a plurality of first inverted-F antennas, a plurality of second inverted-F antennas and a plurality of third inverted-F antennas, thereby being capable of transceiving multi-band wireless signals. Particularly, there is an included angle between any two of the first inverted-F antennas. In the same way, any two of the second inverted-F antennas and any two of the third inverted-F antennas are both arranged to have said included angle therebetween. By such an arrangement, an omni radiation pattern can be measured on X-Y plane, X-Z plane and Y-Z plane in case of this novel Wi-Fi antenna device being applied in an environment. Therefore, the Wi-Fi antenna device according to the present invention has a significant potential for replacing the conventional multi-band antenna so as to be applied in a Wi-Fi router.

16 Claims, 9 Drawing Sheets

WI-FI ANTENNA DEVICE AND WIRELESS COMMUNICATION DEVICE HAVING THE SAME

BACKGROUND OF THE INVENTION

1. Field of the Invention

The present invention relates to the technology field of antenna, and more particularly to a Wi-Fi antenna device for use in transceiving multi-band wireless signals.

2. Description of the Prior Art

Since the use of streaming media service, cloud storage and AIoT is becoming increasingly commonplace in people live, bandwidth and transmission speed of the wireless network are both continuously moved forward so as to get significant enhancement. Recently, IEEE Communications Society has sequentially proposed 5G and 6G cellular communication frameworks for satisfying the requirements of high speed wireless transmission in the further.

It is well known that a Wi-Fi router certainly has an antenna device to transceive wireless signals. It is worth mentioning that, the IEEE 802.11 defines the technical specifications of the wireless LAN standard. The IEEE 802.11ax standard for high efficiency covers MAC and PHY layer operation in the 2.4 GHz, 5 GHz and 6 GHz bands. Therefore, as long as a multi-band antenna is capable of transceiving 2.4 GHz wireless signal, 5 GHz wireless signal, and 6 GHz wireless signal, the Wi-Fi router having the multi-band antenna meets the IEEE standard of Wi-Fi 6.

However, there being still no the multi-band antenna capable of transceiving wireless signals of 2.4 GHz, 5 GHz and 6 GHz be developed and integrated in the Wi-Fi router. In other words, that there are rooms for improvement in the conventional multi-band antenna. In view of that, the inventors of the present application have made great efforts to make inventive research and eventually provided a Wi-Fi antenna device and a wireless communication device having the Wi-Fi antenna device.

SUMMARY OF THE INVENTION

The primary objective of the present invention is to disclose a Wi-Fi antenna device capable of transceiving multi-band wireless signals. The Wi-Fi antenna device comprises: a ground plane, a plurality of first inverted-F antennas, a plurality of second inverted-F antennas and a plurality of third inverted-F antennas, of which there is an included angle between any two of the first inverted-F antennas. In the same way, any two of the second inverted-F antennas and any two of the third inverted-F antennas are both arranged to have said included angle therebetween. By such an arrangement, an omni radiation pattern can be measured on X-Y plane, X-Z plane and Y-Z plane in case of this novel Wi-Fi antenna device being applied in an environment. Therefore, the Wi-Fi antenna device according to the present invention has a significant potential for replacing the conventional multi-band antenna so as to be applied in a Wi-Fi router.

For achieving the primary objective mentioned above, the present invention provides an embodiment of a Wi-Fi antenna assembly, comprising;

a ground plane, having a geometric center and a plurality of slot openings, wherein the plurality of slot openings are arranged in a circular row so as to surround the geometric center;

a plurality of first inverted-F antennas for transceiving a 2.4 GHz Wi-Fi signal, wherein each said first inverted-F antenna comprises a first antenna body, a first ground terminal extended from the first antenna body, and a first signal feed-in terminal extended from the first antenna body, whereof the first ground terminal is connected to one opening edge of said slot opening so as to make the first antenna body be horizontally disposed over the ground plane, and there being an included angle in a range between 60° and 120° between any two adjacent said first antenna bodies;

a plurality of second inverted-F antennas for transceiving a 5 GHz Wi-Fi signal, wherein a total number of the plurality of second inverted-F antennas is equal to that of the plurality of first inverted-F antennas, and each said second inverted-F antenna comprising a second antenna body, a second ground terminal extended from the second antenna body, and a second signal feed-in terminal extended from the second antenna body, whereof the second ground terminal is connected to one opening edge of said slot opening so as to make the second antenna body be horizontally disposed over the ground plane, and there being the same included angle between any two adjacent said second antenna bodies;

a plurality of third inverted-F antennas for transceiving a 6 GHz Wi-Fi signal, wherein a total number of the plurality of third inverted-F antennas is also equal to that of the plurality of first inverted-F antennas, and each said third inverted-F antenna comprising a third antenna body, a third ground terminal extended from the third antenna body, and a third signal feed-in terminal extended from the third antenna body, whereof the third ground terminal is connected to one opening edge of said slot opening so as to make the third antenna body be horizontally disposed over the ground plane, and there being the same included angle between any two adjacent said third antenna bodies.

In one practicable embodiment, one said first inverted-F antenna, one said second inverted-F antenna adjacent to the first inverted-F antenna, and one said third first inverted-F antenna also adjacent to the first inverted-F antenna constitute an antenna group capable of transceiving said 2.4 GHz Wi-Fi signal, said 5 GHz Wi-Fi signal and said 6 GHz Wi-Fi signal, such that said Wi-Fi antenna device includes multiple said antenna groups, and a total number of the antenna groups is selected from a group consisting 3, 4, 5, and 6.

In one embodiment, the Wi-Fi antenna assembly is made of stainless steel.

In one embodiment, the ground plane further has a plurality of orifices.

In another one practicable embodiment, the Wi-Fi antenna assembly further comprises a fourth inverted-F antennas for transceiving a Bluetooth signal, wherein the fourth inverted-F antenna comprises a fourth antenna body, a fourth ground terminal extended from the fourth antenna body, and a fourth signal feed-in terminal extended from the fourth antenna body, and the fourth ground terminal is connected to one opening edge of said slot opening so as to make the fourth antenna body be horizontally disposed over the ground plane.

In one embodiment, a first electrical wire is connected to the first signal feed-in terminal through one said orifice or one said slot openings, a second electrical wire is connected to the second signal feed-in terminal through one said orifice or one said slot openings, and a third electrical wire is connected to the third signal feed-in terminal through one said orifice or one said slot openings.

Moreover, the present invention also provides an embodiment of a Wi-Fi antenna device, comprising;

a housing case;

aforesaid Wi-Fi antenna assembly;

an electrically-controllable adjustment mechanism, being connected to the housing case; and an electronic device, being in communication with the electrically-controllable adjustment mechanism, so as to control the electrically-controllable adjustment mechanism to tilt and/or rotate the housing case, thereby tuning an elevation angle and/or a direction angle of the housing case.

In one practicable embodiment, the Wi-Fi antenna device further comprises:

a circuit board, being disposed in the housing case, and being electrically connected to the Wi-Fi antenna assembly, so as to transmit and/or receive the said 2.4 GHz Wi-Fi signal, the 5 GHz Wi-Fi signal and/or the 6 GHz Wi-Fi signal through the Wi-Fi antenna assembly;

a first heat sink, being disposed in the housing case, and being positioned between the Wi-Fi antenna assembly and the circuit board; and a second heat sink, being connected to a bottom surface of the circuit board.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a Wi-Fi antenna device and a wireless communication device having the Wi-Fi antenna device, embodiments of the present invention will be described in detail with reference to the attached drawings hereinafter.

Wi-Fi Antenna Assembly

Figure 1:
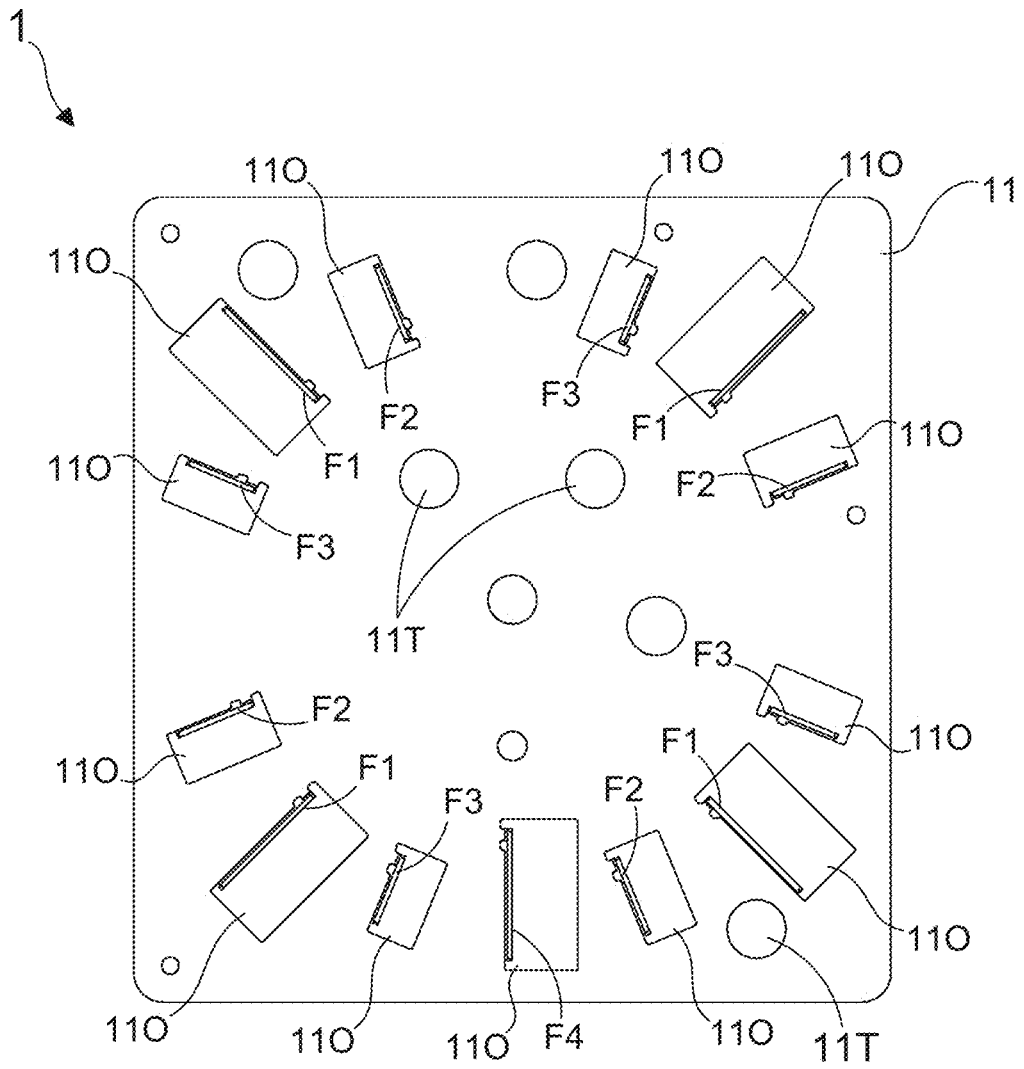
FIG. 1 shows an elevation view of a Wi-Fi antenna assembly according to the present invention.
Figure 2:
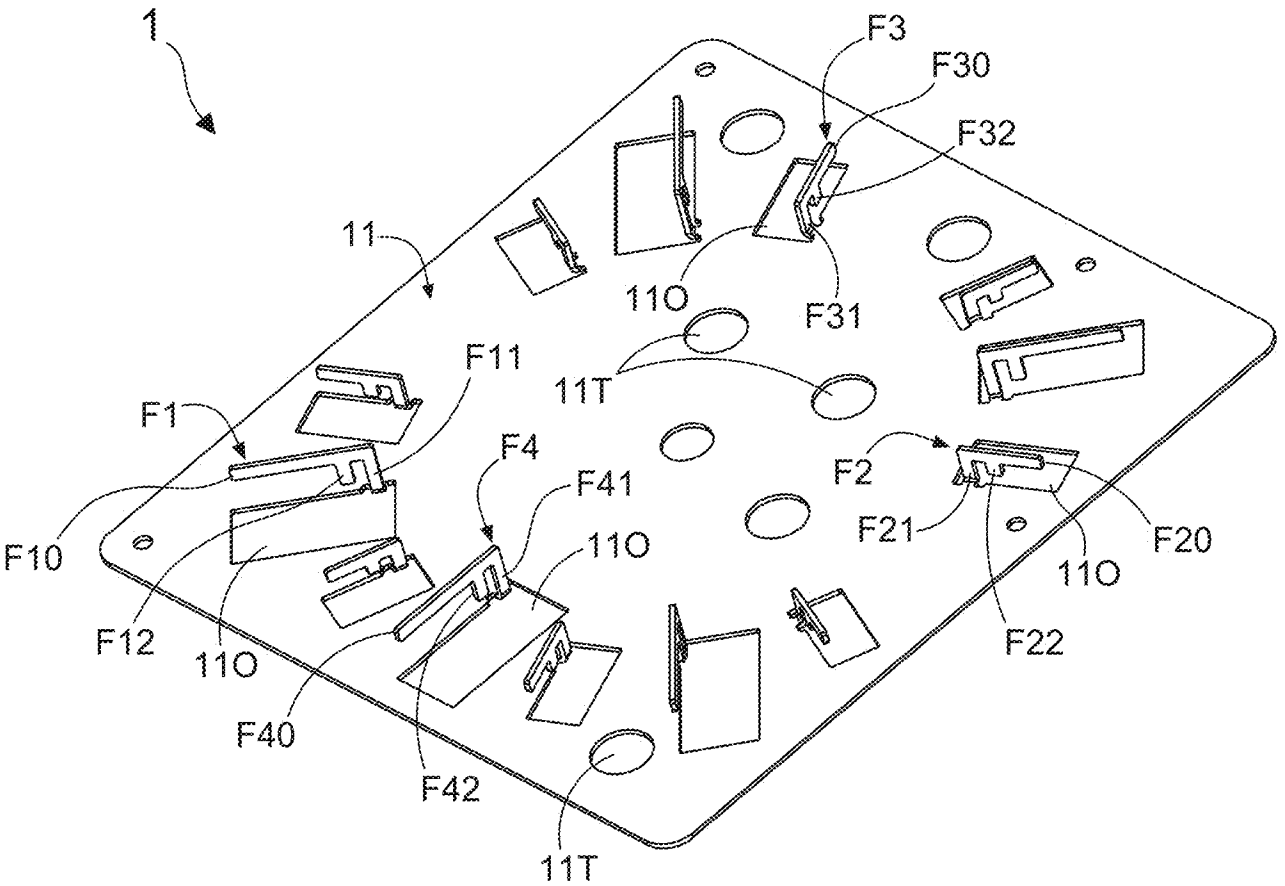
FIG. 2 shows a top view of the Wi-Fi antenna assembly according to the present invention.

With reference to FIG. 1, there is shown an elevation view of a Wi-Fi antenna assembly according to the present invention. Moreover, FIG. 2 illustrates a top view of the Wi-Fi antenna assembly. According to FIG. 1 and FIG. 2, the present invention discloses a Wi-Fi antenna assembly 1 capable of transceiving multi-band wireless signals. The Wi-Fi antenna assembly 1 comprises: a ground plane 11, a plurality of first inverted-F antennas F1, a plurality of second inverted-F antennas F2 and a plurality of third inverted-F antennas F3, of which the ground plane 11 has a geometric center and a plurality of slot openings 11O. Particularly, the plurality of slot openings 11O are arranged in a circular row so as to surround the geometric center.

Figure 3:
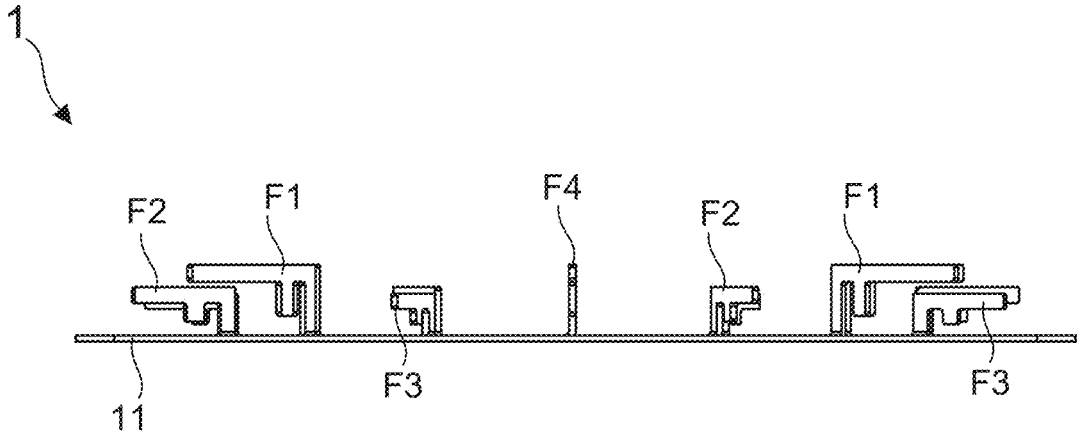
FIG. 3 shows a first side view of the Wi-Fi antenna assembly according to the present invention.
Figure 4:
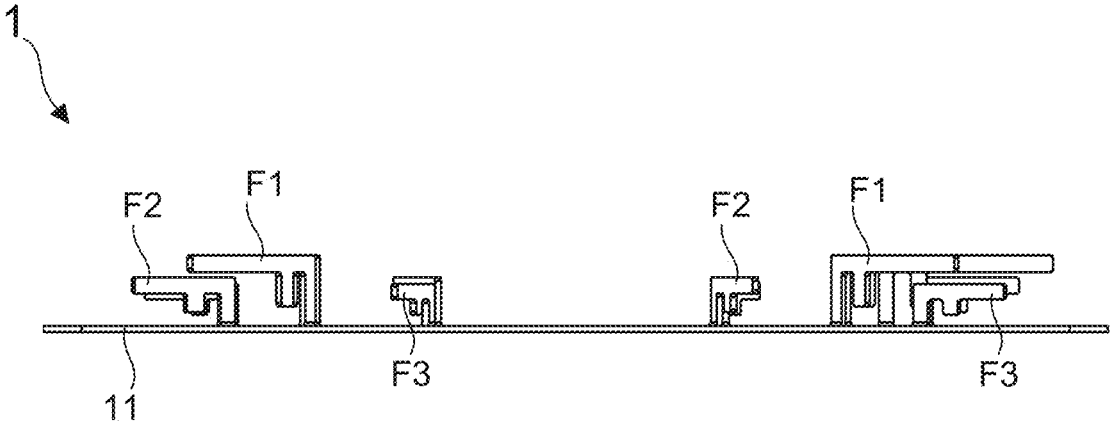
FIG. 4 shows a second side view of the Wi-Fi antenna assembly according to the present invention.

Furthermore, FIG. 3 and FIG. 4 respectively show a first side view and a second side view of the Wi-Fi antenna assembly according to the present invention. According to FIG. 1, FIG. 2, FIG. 3, and FIG. 4 show, the plurality of first inverted-F antennas F1 are configured for transceiving a 2.4 GHz Wi-Fi signal, and each said first inverted-F antenna F1 comprises a first antenna body F10, a first ground terminal F11 extended from the first antenna body F10, and a first signal feed-in terminal F12 extended from the first antenna body F10. In which, the first ground terminal F11 is connected to one opening edge of said slot opening 11O so as to make the first antenna body F10 be horizontally disposed over the ground plane 11, and there is an included angle in a range between 60° and 120° between any two adjacent said first antenna bodies F10. For example, FIG. 1 and FIG. 2 exemplarily depict that the total number of the first antenna bodies F10 disposed on the ground plane 11 is 4, wherefore the included angle between two adjacent said first antenna bodies F10 is 90°.

On the other hand, the plurality of second inverted-F antennas F2 are configured for transceiving a 5 GHz Wi-Fi signal. According to the present invention, a total number of the plurality of second inverted-F antennas F2 is equal to that of the plurality of first inverted-F antennas F1, and each said second inverted-F antenna F2 comprises a second antenna body F20, a second ground terminal F21 extended from the second antenna body F20, and a second signal feed-in terminal F22 extended from the second antenna body F20. As FIG. 1 and FIG. 2 show, the second ground terminal F21 is connected to one opening edge of said slot opening 11O so as to make the second antenna body F20 be horizontally disposed over the ground plane 11, and there is the same included angle between any two adjacent said second antenna bodies F20. For example, FIG. 1 and FIG. 2 exemplarily depict that the total number of the second antenna bodies F20 disposed on the ground plane 11 is 4, wherefore the included angle between two adjacent said second antenna bodies F20 is 90°.

According to FIG. 1, FIG. 2, FIG. 3, and FIG. 4 show, the plurality of third inverted-F antennas F3 are configured for transceiving a 6 GHz Wi-Fi signal. Particularly, a total number of the plurality of third inverted-F antennas F3 is also equal to that of the plurality of first inverted-F antennas F1, and each said third inverted-F antenna F3 comprises a third antenna body F30, a third ground terminal F31 extended from the third antenna body F30, and a third signal feed-in terminal F32 extended from the third antenna body F30. According to the present invention, the third ground terminal F31 is connected to one opening edge of said slot opening 11O so as to make the third antenna body F30 be horizontally disposed over the ground plane 11, and there is the same included angle between any two adjacent said third antenna bodies F30. For example, FIG. 1 and FIG. 2 exemplarily depict that the total number of the third antenna bodies F30 disposed on the ground plane 11 is 4, wherefore the included angle between two adjacent said third antenna bodies F30 is 90°.

As result of that, according to FIG. 1 and FIG. 2, one said first inverted-F antenna F1, one said second inverted-F antenna F2 adjacent to the first inverted-F antenna F1, and one said third first inverted-F antenna F3 also adjacent to the first inverted-F antenna F1 constitute an antenna group capable of transceiving said 2.4 GHz Wi-Fi signal, said 5 GHz Wi-Fi signal and said 6 GHz Wi-Fi signal, and the Wi-Fi antenna assembly 1 includes multiple (i.e., 4) said antenna groups. Of course, the total number of the antenna groups is relied upon said included angle. As described in more detail below, with the included angle varying from 60° to 120°, the total number of the antenna groups is correspondingly 3, 4, 5, or 6.

In a prefer embodiment, according to FIG. 1 and FIG. 2, the total number of the antenna groups is 4. In such case, the first inverted-F antenna F1 is disposed at a position between the second inverted-F antenna F2 and the third inverted-F antenna F3 in each said antenna group. By such an arrangement, an omni radiation pattern can be measured on X-Y plane, X-Z plane and Y-Z plane in case of this Wi-Fi antenna assembly 1 being applied in an environment. As a result, the Wi-Fi antenna assembly 1 according to the present invention has a significant potential for replacing the conventional multi-band antenna so as to be applied in a Wi-Fi router.

In one practicable embodiment, the Wi-Fi antenna assembly 1 can be designed to further comprises a fourth inverted-F antennas F4 as shown in FIG. 1 and FIG. 2. The fourth inverted-F antennas F4 is configured for transceiving a Bluetooth signal, and comprises a fourth antenna body F40, a fourth ground terminal F41 extended from the fourth antenna body F40, and a fourth signal feed-in terminal F42 extended from the fourth antenna body F40. According to FIG. 1 and FIG. 2, the fourth ground terminal F41 is connected to one opening edge of said slot opening 11O so as to make the fourth antenna body F40 be horizontally disposed over the ground plane 11. As described in more detail below, it can operate a punching machine to complete at least one punching process on a stainless steel, so as to transform the stainless steel to the Wi-Fi antenna 1 consisting of a ground plane 11, a plurality of first inverted-F antennas F1, a plurality of second inverted-F antennas F2, a plurality of third inverted-F antennas F3, and a plurality of fourth inverted-F antennas F4. Furthermore, it is able to make the ground plane 11 further has a plurality of orifices 11T. By such arrangements, a first electrical wire can be connected to the first signal feed-in terminal F12 through one said orifice 11T or one said slot openings 11O, a second electrical wire can be connected to the second signal feed-in terminal F22 through one said orifice 11T or one said slot openings 11O, and a third electrical wire can be connected to the third signal feed-in terminal F22 through one said orifice 11T or one said slot openings 11O.

Wi-Fi Antenna Device

Figure 5:
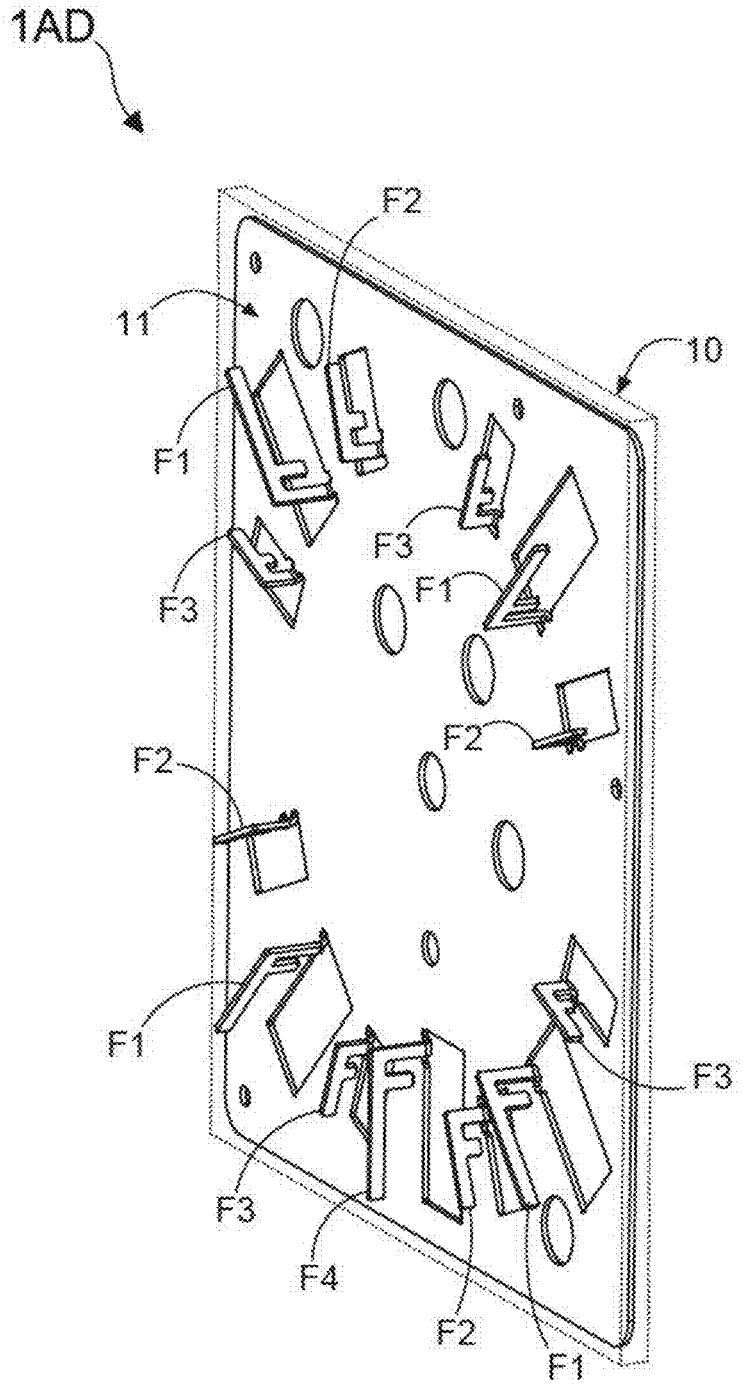
FIG. 5 shows an elevation view of a Wi-Fi antenna device according to the present invention.
Figure 6:
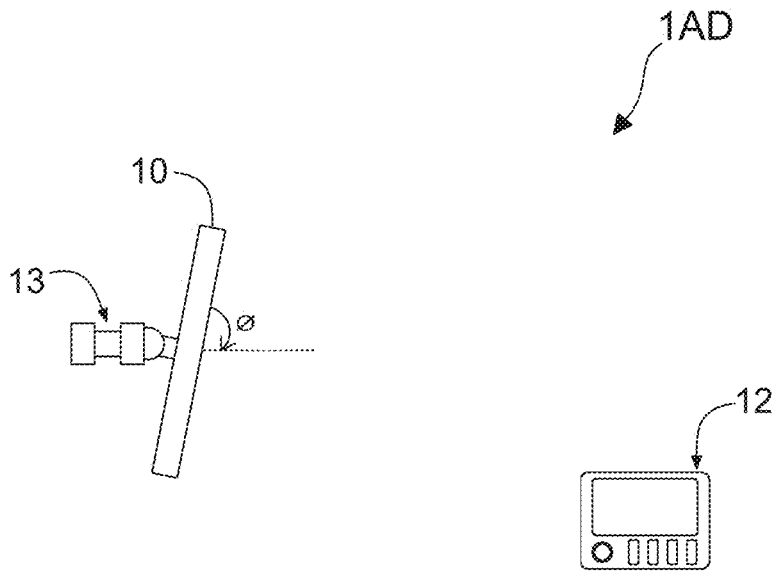
FIG. 6 shows a side view of the Wi-Fi antenna device according to the present invention.
Figure 7:
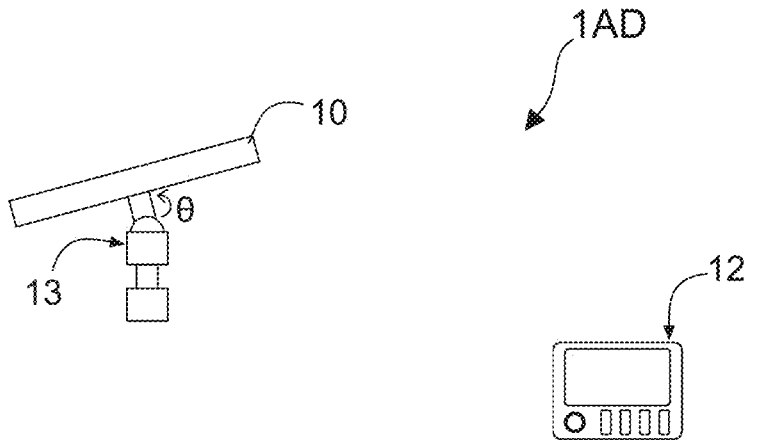
FIG. 7 shows a top view of the Wi-Fi antenna device according to the present invention.

With reference to FIG. 5, there is shown an elevation view of a Wi-Fi antenna device according to the present invention. Moreover, FIG. 6 and FIG. 7 respectively show a side view and a top view of the Wi-Fi antenna device. According to FIG. 5, FIG. 6 and FIG. 7, the Wi-Fi antenna device 1AD comprises: a first housing case 10, aforesaid Wi-Fi antenna assembly 1, an electrically-controllable adjustment mechanism 13, and an electronic device 12, of which the Wi-Fi antenna assembly 1 is disposed in the housing case 10. On the other hand, the electrically-controllable adjustment mechanism 13 is connected to the first housing case 10, and the electronic device 12 is in communication with the electrically-controllable adjustment mechanism 13. By such arrangements, a user is able to place the Wi-Fi antenna device 1AD in an environment like living room, and is also allowed to operate the electronic device 12 for controlling the electrically-controllable adjustment mechanism 13 to tilt and/or rotate the housing case 10, so as to tune an elevation angle Ø and/or a direction angle θ of the first housing case 10, thereby an omni radiation pattern produced by the Wi-Fi antenna device 1AD can be measured on X-Y plane, X-Z plane and Y-Z plane. Therefore, the Wi-Fi antenna device according to the present invention has a significant potential for replacing the conventional multi-band antenna so as to be applied in a Wi-Fi router.

Wireless Communication Device

Figure 8:
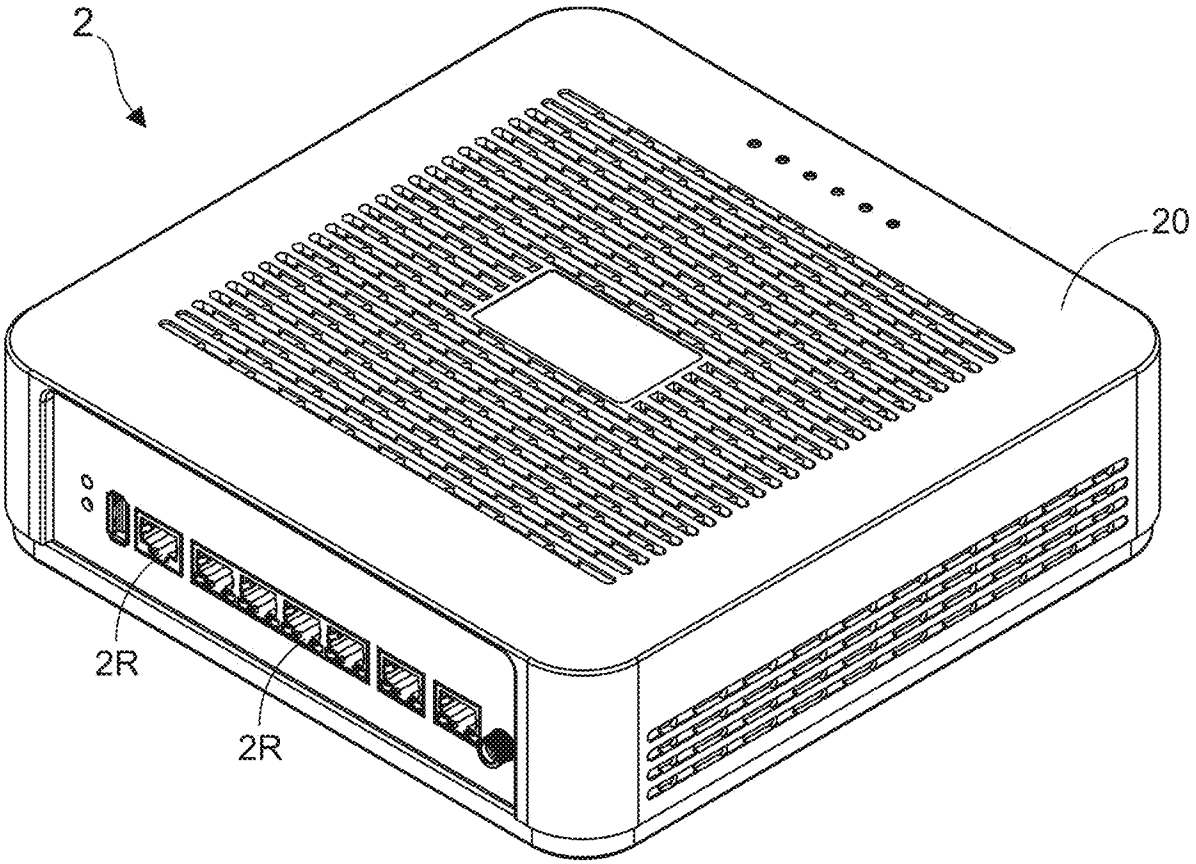
FIG. 8 shows a first elevation view of a wireless communication device having the Wi-Fi antenna assembly according to the present invention.
Figure 9:
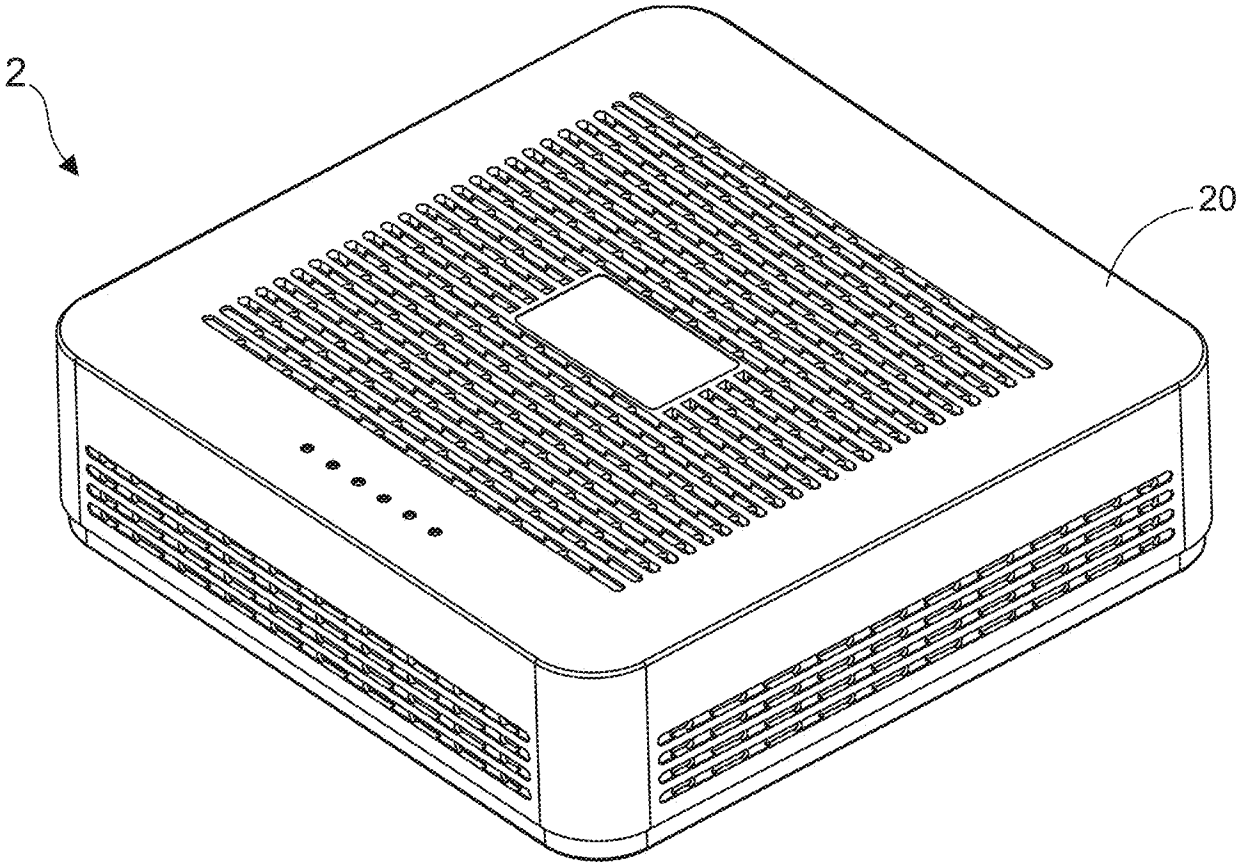
FIG. 9 shows a second elevation view of the wireless communication device.
Figure 10:
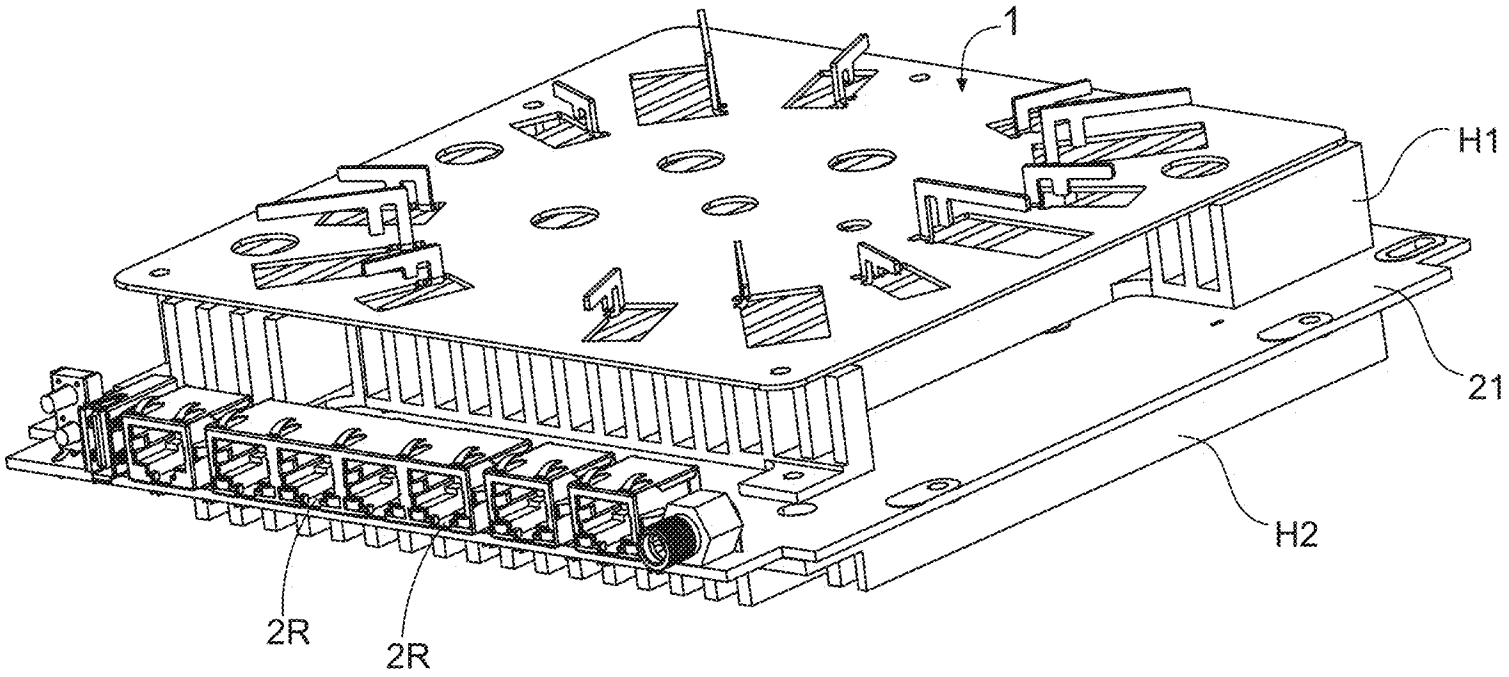
FIG. 10 shows a diagram for describing necessary some of electronic components that are disposed in a housing case of the wireless communication device.

With reference to FIG. 8, there is shown a first elevation view of a wireless communication device having the Wi-Fi antenna assembly according to the present invention. Moreover, FIG. 9 illustrates a second elevation view of the wireless communication device, and FIG. 10 shows a diagram for describing necessary some of electronic components that are disposed in a second housing case 20 of the wireless communication device 2. According to the present invention, a wireless communication device 2 having aforesaid Wi-Fi antenna assembly 1 is simultaneously proposed. The wireless communication device 2 comprises: a second housing case 20, a circuit board 21, said Wi-Fi antenna assembly 1, a first heat sink H1, and a second heat sink H2, of which the circuit board 21 is disposed in the housing case 10, and is electrically connected to the Wi-Fi antenna assembly 1, so as to transmit and/or receive the 2.4 GHz Wi-Fi signal, the 5 GHz Wi-Fi signal and/or the 6 GHz Wi-Fi signal through the Wi-Fi antenna assembly 1. In addition, according to FIG. 8, FIG. 9, and FIG. 10, there are a plurality of Ethernet connectors 2R disposed on the circuit board 21, such that the circuit board 21 is also able to transmit and/or receive Ethernet signals through the Ethernet connectors.

As FIG. 10 shows, the first heat sink H1 is disposed in the housing case 10, and is positioned between the Wi-Fi antenna assembly and the circuit board 21. On the other hand, the second heat sink H2 is connected to a bottom surface of the circuit board 21. It should be understood that, there are certainly at least one microprocessor and at least one signal conversion chip disposed on the circuit board 21 for dealing with the Ethernet signals and the multi-band Wi-Fi signals. Therefore, the first heat sink H1 and the second heat sink H2 are disposed in the second housing case 20 for conducting heat dissipation of the circuit board 11.

Figure 11:
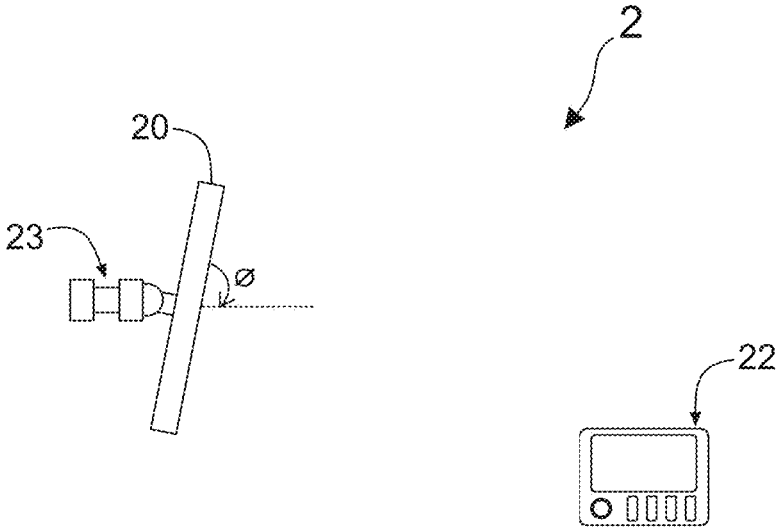
FIG. 11 shows a side view of the wireless communication device.
Figure 12:
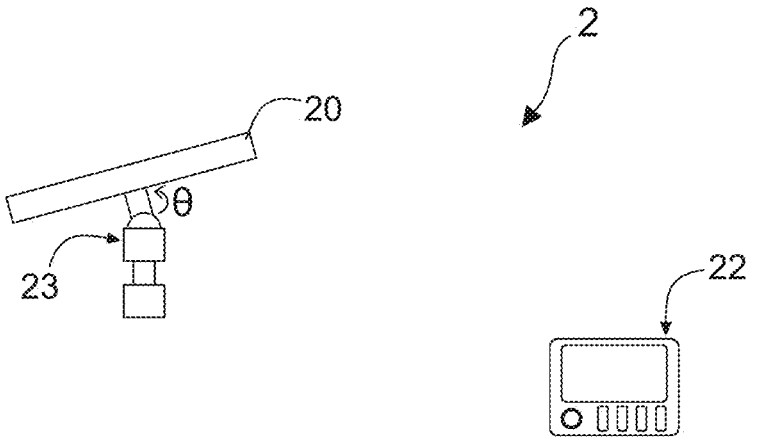
FIG. 12 shows a top view of the wireless communication device.

Furthermore, FIG. 11 illustrate a side view of the wireless communication device 2, and FIG. 12 shows a top view of the wireless communication device 2. In one practicable embodiment, an electrically-controllable adjustment mechanism 23 is connected to the second housing case 20, and an electronic device 22 is in communication with the electrically-controllable adjustment mechanism 23. By such arrangements, a user is able to place the wireless communication device 2 in an environment like living room, and is also allowed to operate the electronic device 22 for controlling the electrically-controllable adjustment mechanism 23 to tilt and/or rotate the second housing case 20, so as to tune an elevation angle Ø and/or a direction angle θ of the second housing case 20, thereby an omni radiation pattern produced by the Wi-Fi antenna assembly 1 can be measured on X-Y plane, X-Z plane and Y-Z plane.

Therefore, through the above descriptions, all embodiments of the Wi-Fi antenna device and the wireless communication device having the Wi-Fi antenna device according to the present invention have been introduced completely and clearly. Moreover, the above description is made on embodiments of the present invention. However, the embodiments are not intended to limit the scope of the present invention, and all equivalent implementations or alterations within the spirit of the present invention still fall within the scope of the present invention.

What is claimed is:

1. A Wi-Fi antenna assembly 1, comprising:

a ground plane 11, having a geometric center and a plurality of slot openings 11O, wherein the plurality of slot openings 11O are arranged in a circular row so as to surround the geometric center;

a plurality of first inverted-F antennas F1 for transceiving a 2.4 GHz Wi-Fi signal, wherein each said first inverted-F antenna F1 comprises a first antenna body F10, a first ground terminal F11 extended from the first antenna body F10, and a first signal feed-in terminal F12 extended from the first antenna body F10, whereof the first ground terminal F11 is connected to one opening edge of said slot opening 11O so as to make the first antenna body F10 be horizontally disposed over the ground plane 11, and there being an included angle in a range between 60° and 120° between any two adjacent said first antenna bodies F10;

a plurality of second inverted-F antennas F2 for transceiving a 5 GHz Wi-Fi signal, wherein a total number of the plurality of second inverted-F antennas F2 is equal to that of the plurality of first inverted-F antennas F1, and each said second inverted-F antenna F2 comprising a second antenna body F20, a second ground terminal F21 extended from the second antenna body F20, and a second signal feed-in terminal F22 extended from the second antenna body F20, whereof the second ground terminal F21 is connected to one opening edge of said slot opening 11O so as to make the second antenna body F20 be horizontally disposed over the ground plane 11, and there being the same included angle between any two adjacent said second antenna bodies F20;

a plurality of third inverted-F antennas F3 for transceiving a 6 GHz Wi-Fi signal, wherein a total number of the plurality of third inverted-F antennas F3 is also equal to that of the plurality of first inverted-F antennas F1, and each said third inverted-F antenna F3 comprising a third antenna body F30, a third ground terminal F31 extended from the third antenna body F30, and a third signal feed-in terminal F32 extended from the third antenna body F30, whereof the third ground terminal F31 is connected to one opening edge of said slot opening 11O so as to make the third antenna body F30 be horizontally disposed over the ground plane 11, and there being the same included angle between any two adjacent said third antenna bodies F30.

2. The Wi-Fi antenna assembly of claim 1, wherein one said first inverted-F antenna F1, one said second inverted-F antenna F2 adjacent to the first inverted-F antenna F1, and one said third first inverted-F antenna F3 also adjacent to the first inverted-F antenna F1 constitute an antenna group capable of transceiving said 2.4 GHz Wi-Fi signal, said 5 GHz Wi-Fi signal and said 6 GHz Wi-Fi signal, such that said Wi-Fi antenna assembly includes multiple said antenna groups, and a total number of the antenna groups being selected from a group consisting 3, 4, 5, and 6.

3. The Wi-Fi antenna assembly of claim 2, wherein the first inverted-F antenna F1 is disposed at a position between the second inverted-F antenna F2 and the third inverted-F antenna F3 in each said antenna group.

4. The Wi-Fi antenna assembly of claim 1, being made of stainless steel.

5. The Wi-Fi antenna assembly of claim 1, wherein the ground plane 11 further has a plurality of orifices 11T.

6. The Wi-Fi antenna assembly of claim 5, wherein a first electrical wire is connected to the first signal feed-in terminal F12 through one said orifice 11T or one said slot openings 11O, a second electrical wire being connected to the second signal feed-in terminal F22 through one said orifice 11T or one said slot openings 11O, and a third electrical wire being connected to the third signal feed-in terminal F22 through one said orifice 11T or one said slot openings 11O.

7. The Wi-Fi antenna assembly of claim 1, further comprising a fourth inverted-F antennas F4 for transceiving a Bluetooth signal, wherein the fourth inverted-F antenna F4 comprises a fourth antenna body F40, a fourth ground terminal F41 extended from the fourth antenna body F40, and a fourth signal feed-in terminal F42 extended from the fourth antenna body F40, and the fourth ground terminal F41 being connected to one opening edge of said slot opening 11O so as to make the fourth antenna body F40 be horizontally disposed over the ground plane 11.

8. A Wi-Fi antenna device 1AD, comprising:

a housing case 10;

a Wi-Fi antenna assembly 1, comprising:

a ground plane 11, being disposed in the housing case 10, and having a geometric center and a plurality of slot openings 11O, wherein the plurality of slot openings 11O are arranged in a circular row so as to surround the geometric center;

a plurality of first inverted-F antennas F1, being configured for transceiving a 2.4 GHz Wi-Fi signal, and being disposed in the housing case 10; wherein each said first inverted-F antenna F1 comprises a first antenna body F10, a first ground terminal F11 extended from the first antenna body F10, and a first signal feed-in terminal F12 extended from the first antenna body F10, whereof the first ground terminal F11 is connected to one opening edge of said slot opening 11O so as to make the first antenna body F10 be horizontally disposed over the ground plane 11, and there being an included angle in a range between 60° and 120° between any two adjacent said first antenna bodies F10;

a plurality of second inverted-F antennas F2, being configured for transceiving a 5 GHz Wi-Fi signal, and being disposed in the housing case 10; wherein a total number of the plurality of second inverted-F antennas F2 is equal to that of the plurality of first inverted-F antennas F1, and each said second inverted-F antenna F2 comprising a second antenna body F20, a second ground terminal F21 extended from the second antenna body F20, and a second signal feed-in terminal F22 extended from the second antenna body F20, whereof the second ground terminal F21 is connected to one opening edge of said slot opening 11O so as to make the second antenna body F20 be horizontally disposed over the ground plane 11, and there being the same included angle between any two adjacent said second antenna bodies F20; and a plurality of third inverted-F antennas F3, being configured for transceiving a 6 GHz Wi-Fi signal, and being disposed in the housing case 10; wherein a total number of the plurality of third inverted-F antennas F3 is also equal to that of the plurality of first inverted-F antennas F1, and each said third inverted-F antenna F3 comprising a third antenna body F30, a third ground terminal F31 extended from the third antenna body F30, and a third signal feed-in terminal F32 extended from the third antenna body F30, whereof the third ground terminal F31 is connected to one opening edge of said slot opening 11O so as to make the third antenna body F30 be horizontally disposed over the ground plane 11, and there being the same included angle between any two adjacent said third antenna bodies F30;

an electrically-controllable adjustment mechanism 13, being connected to the housing case 10; and an electronic device 12, being in communication with the electrically-controllable adjustment mechanism 13, so as to control the electrically-controllable adjustment mechanism 13 to tilt and/or rotate the housing case 10, thereby tuning an elevation angle and/or a direction angle of the housing case 10.

9. The Wi-Fi antenna device of claim 8, further comprising:

a circuit board 21, being disposed in the housing case 10, and being electrically connected to the Wi-Fi antenna assembly, so as to transmit and/or receive the 2.4 GHz Wi-Fi signal, the 5 GHz Wi-Fi signal and/or the 6 GHz Wi-Fi signal through the Wi-Fi antenna assembly;

a first heat sink H1, being disposed in the housing case 10, and being positioned between the Wi-Fi antenna assembly and the circuit board 21; and a second heat sink H2, being connected to a bottom surface of the circuit board 21.

10. The Wi-Fi antenna device of claim 9, wherein there are a plurality of Ethernet connectors 2R disposed on the circuit board 21.

11. The Wi-Fi antenna device of claim 8, wherein one said first inverted-F antenna F1, one said second inverted-F antenna F2 adjacent to the first inverted-F antenna F1, and one said third first inverted-F antenna F3 also adjacent to the first inverted-F antenna F1 constitute an antenna group capable of transceiving said 2.4 GHz Wi-Fi signal, said 5 GHz Wi-Fi signal and said 6 GHz Wi-Fi signal, such that said Wi-Fi antenna device includes multiple said antenna groups, and a total number of the antenna groups being selected from a group consisting 3, 4, 5, and 6.

12. The Wi-Fi antenna device of claim 11, wherein the first inverted-F antenna F1 is disposed at a position between the second inverted-F antenna F2 and the third inverted-F antenna F3 in each said antenna group.

13. The Wi-Fi antenna device of claim 8, being made of stainless steel.

14. The Wi-Fi antenna device of claim 8, wherein the ground plane 11 further has a plurality of orifices 11T.

15. The Wi-Fi antenna device of claim 14, wherein a first electrical wire is connected to the first signal feed-in terminal F12 through one said orifice 11T or one said slot openings 11O, a second electrical wire being connected to the second signal feed-in terminal F22 through one said orifice 11T or one said slot openings 11O, and a third electrical wire being connected to the third signal feed-in terminal F22 through one said orifice 11T or one said slot openings 11O.

16. The Wi-Fi antenna device of claim 8, further comprising a fourth inverted-F antennas F4 for transceiving a Bluetooth signal, wherein the fourth inverted-F antenna F4 comprises a fourth antenna body F40, a fourth ground terminal F41 extended from the fourth antenna body F40, and a fourth signal feed-in terminal F42 extended from the fourth antenna body F40, and the fourth ground terminal F41 being connected to one opening edge of said slot opening 11O so as to make the fourth antenna body F40 be horizontally disposed over the ground plane 11.

* * * * *